US006447578B1

(12) United States Patent
Ciccarelli

(10) Patent No.: US 6,447,578 B1
(45) **Date of Patent: *Sep. 10, 2002**

(54) PROCESS FOR THE REMOVAL OF NITROGEN CONTAINED IN NATURAL GAS

(75) Inventor: Liberato Ciccarelli, San Giuliano Milanese (IT)

(73) Assignee: ENI S.p.A., Rome (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/504,960

(22) Filed: Feb. 16, 2000

(30) Foreign Application Priority Data

Feb. 19, 1999 (IT) ..... MI99A0337

(51) Int. Cl.[7] ..... F25H 3/02

(52) U.S. Cl. ..... 95/179; 95/50; 95/184; 95/237; 585/867

(58) Field of Search ..... 95/50, 51, 208, 95/237, 156, 186, 187, 178, 179, 184; 585/803, 867

(56) References Cited

U.S. PATENT DOCUMENTS 4,623,371 A * 11/1986 Mehra
4,680,042 A * 7/1987 Mehra
4,696,688 A * 9/1987 Mehra
4,832,718 A 5/1989 Mehra ..... 62/17
4,936,887 A * 6/1990 Waldo et al.
5,047,074 A * 9/1991 MacGregor et al.
5,321,952 A * 6/1994 Forte
5,462,583 A 10/1995 Wood et al. ..... 95/192
5,551,972 A 9/1996 Wood et al. ..... 95/192
5,647,227 A * 7/1997 Lockhandwala ..... 95/50

OTHER PUBLICATIONS

Patent Abstracts of Japan, vol. 1996, No. 08, Aug. 30, 1996, JP 08 089770, Apr. 9, 1996.

* cited by examiner

*Primary Examiner*—David A. Simmons
*Assistant Examiner*—Frank M. Lawrence
(74) *Attorney, Agent, or Firm*—Oblon, Spivak, McClelland, Maier & Neustadt, P.C.

(57) ABSTRACT

Process for the removal of nitrogen contained in natural gas wherein are performed the steps of:

a) absorbing the hydrocarbon component of natural gas by means of virgin naphtha in an absorption device, discharging the non-absorbed nitrogen;

b) stripping the hydrocarbon component absorbed by the virgin naphtha;

c) recycling the virgin naphtha recovered in the stripping, to step (a);

d) feeding the natural gas thus treated to a distribution network.

5 Claims, 1 Drawing Sheet

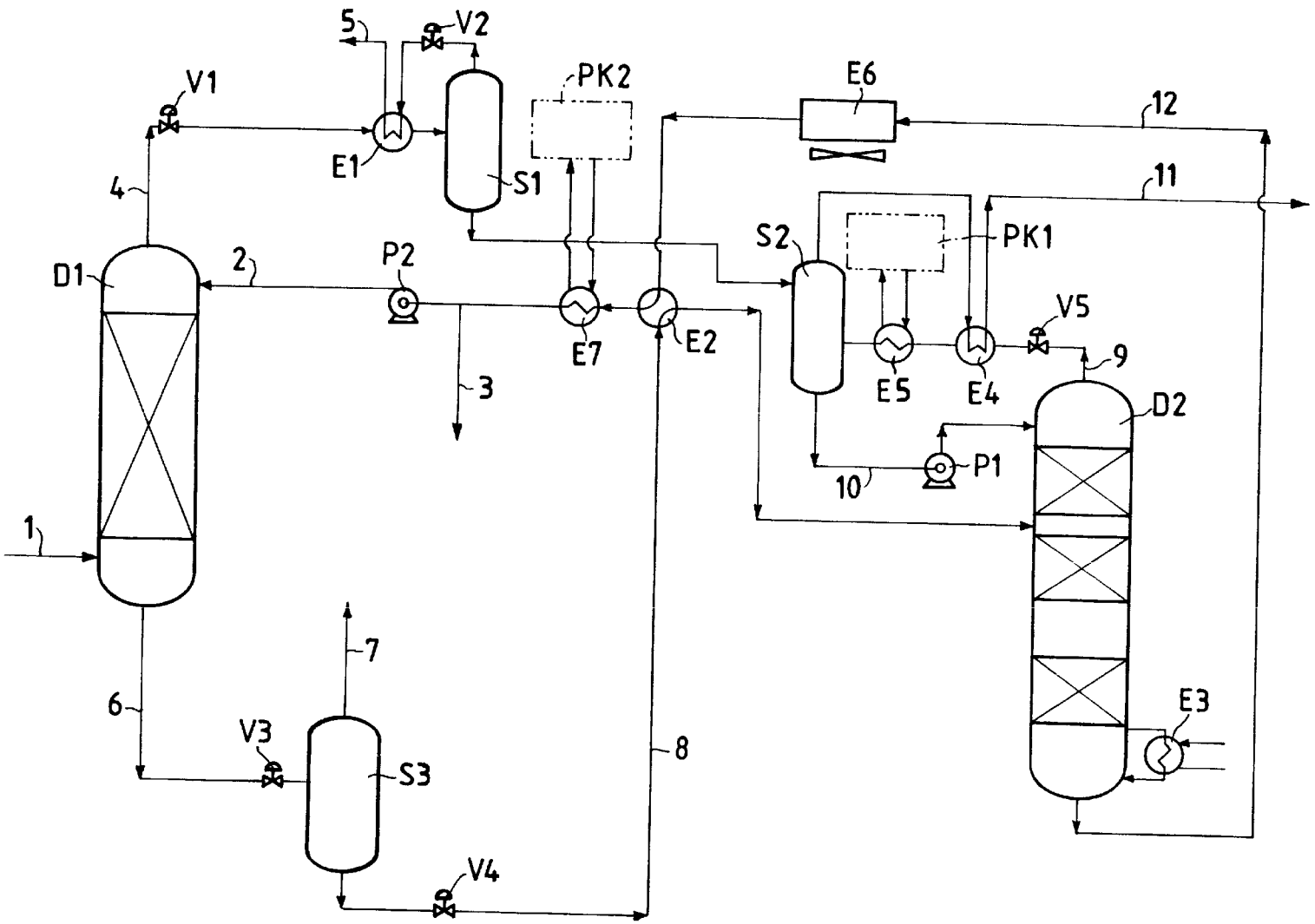
1
2
3
4
5
6
7
8
9
10
11
12
D1
D2
E1
E2
E3
E4
E5
E6
E7
P1
P2
PK1
PK2
S1
S2
S3
V1
V2
V3
V4
V5

PROCESS FOR THE REMOVAL OF NITROGEN CONTAINED IN NATURAL GAS

BACKGROUND OF THE INVENTION

1. Field of the Invention

The present invention relates to a process for the removal of nitrogen contained in natural gas.

More specifically, the present invention relates to a process for the reduction of the nitrogen content in natural gas to a concentration of less than 10% molar.

2. Description of Related Art

As is known, natural gas has become a source of thermal energy which is one of the main alternatives to traditional fuels of a fossil nature, in particular fuel oils of petroleum origin, considered as being one of the main causes of the greenhouse effect which influences the climatic trend of the planet.

Natural gas, coming from production fields, essentially consists of methane but may also contain, in addition to significant traces of upper $C_2$–$C_7$+ hydrocarbons, varying quantities of inert gases, for example carbon dioxide or nitrogen, whose presence must be eliminated or reduced to satisfy specifications of use.

Among these specifications is that of respecting the Wobbe index, a parameter Refined by the ratio between the calorific value (high or low) of gas and its density with respect to air. The Wobbe index is therefore a parameter which represents a measurement of the heat which is produced by the gas when burnt at a constant pressure.

Methods for the removal of inert gases, in particular nitrogen, from natural gas, are known in scientific literature. Most of these processes, however, are essentially based on removing nitrogen cryogenically as described, for example, in U.S. Pat. Nos. 5,505,049, 5,036,671 or 4,415,345, with effective but not economic results.

U.S. Pat. No. 5,321,952 discloses an alternative to cryogenic processes, which comprises absorbing the hydrocarbon fraction of natural gas (essentially methane) in a $C_9$–$C_{14}$ paraffinic oil and discharging the inert gases (essentially nitrogen) thus separated into the atmosphere or another operating unit. The use of paraffinic oil as absorbing liquid, however, implies a series of disadvantages which make the absorption process, as an alternative to cryogenic processes, much less competitive with respect to the latter.

Above all, the absorption process with paraffinic oil requires particular operating conditions. In fact, even if there is the possibility of operating at room temperature, in practice, it is advisable to operate at a temperature ranging from −40 to −10° C. with the consequent necessity of forced dehydration of the gas to avoid freezing phenomena inside the equipment.

A second disadvantage, much more serious than the first, occurs in the desorption phase for the recovery of the gas. This operation takes place by expansion of the paraffinic oil in flash columns arranged in series. At the end of the expansion, the paraffinic oil is recycled to the absorption whereas the gas is, partly sent to a compression section to be fed to a distribution network, and is partly recycled to the absorption. This compression phase alone clearly makes the process less competitive.

A further disadvantage of the process described in U.S. Pat. No. 5,321,952 can be identified in the absorption section where it is necessary to operate with two columns, one fed with natural gas coming from the production, the other with recycled gas.

SUMMARY OF THE INVENTION

The Applicant has now found that the simple substitution of paraffinic oil with a lighter and less viscous liquid, for example, with a virgin naphtha, surprisingly eliminates the above drawbacks. At the same time, a separation process is obtained, which is as effective as cryogenic systems but without the high costs involved.

The object of the present invention therefore relates to a process for the removal of nitrogen contained in natural gas which comprises:

a) absorbing the hydrocarbon component of natural gas by means of virgin naphtha, essentially consisting of $C_5$–$C_8$ paraffins, in an absorption device, discharging the non-absorbed nitrogen;

b) stripping the hydrocarbon component from the virgin naphtha in a stripping column operating at a temperature at the bottom ranging from 150 to 200° C.;

c) recycling the virgin naphtha, recovered in the stripping, to step (a);

d) feeding the stripped hydrocarbon component to a distribution network.

BRIEF DESCRIPTION OF THE DRAWINGS

The Figure is a schematic drawing illustrating the process of the invention.

DETAILED DESCRIPTION OF THE INVENTION

The natural gas fed to the absorption step is generally pretreated to eliminate or reduce the upper hydrocarbons and other inert gases such as, for example, carbon dioxide, possibly present. The pretreatment operations comprise feeding the gas to a filtering and heating unit. The $CO_2$ and possible traces of humidity can be eliminated by means of permeation through membranes. More detailed information on permeation through membranes can be found in "Polymeric Gas Separation Membranes" R. E. Kesting, A. K. Fritzsche, Wiley Interscience, 1993.

The absorption step preferably takes place in a plate column or in a packed column, feeding the natural gas to the bottom and the virgin naphtha to the head.

The term "virgin naphtha", as used in the present description and claims, refers to a petroleum cut essentially consisting of a mixture of hydrocarbons liquid at room temperature in which the number of carbon atoms of the single components mainly ranges from 5 to 8 and having an average boiling point ranging from 35° C. approximately of pentane to 125° C. approximately of octane.

The absorption substantially takes place at room temperature and at a pressure equal to that of the production of natural gas, in plate columns or packed columns, wherein the packing is preferably arranged in an orderly manner and not at random. A gas stream, essentially consisting of nitrogen, is discharged from the head of the column, whereas the absorbing fluid containing the hydrocarbon component of natural gas, essentially methane, is recovered at the bottom.

The latter is recovered in the stripping column, operating at a pressure which is lower than that of the absorption column but higher, or substantially equal, to that in the distribution network, and is fed to the network itself. If some of the components of the virgin naphtha (the lighter ones) are entrained during the stripping phase, a recovery step of these products with a freezing cycle, can be included.

The process for the removal of nitrogen contained in natural gas object of the present invention can be better understood by referring to the drawing of the enclosed figure which represents an illustrative but non-limiting embodiment thereof.

The natural gas containing nitrogen (1), pretreated to eliminate humidity, carbon dioxide and possibly other undesirable gases such as $H_2S$, is fed to the base of the absorption column D1. The virgin naphtha is fed to the head of the column D1 by means of feeding line (2). The virgin naphtha is generally recycled virgin naphtha (12).

A gas stream (4) essentially consisting of nitrogen is extracted from the head of the column D1, which, after expansion by means of valve V1 and subsequent cooling in the exchanger E1, goes to the gas-liquid separator S1. The remaining gas stream (5) is discharged from the separator S1, after expansion in V2 and the discharging of frigories in E1.

The liquid collected on the bottom of the tank S1, essentially consisting of virgin naphtha entrained by the nitrogen, is fed to the separator S2 which regulates the reflux of the subsequent stripping column D2.

A liquid stream (6) essentially consisting of virgin naphtha and natural gas dissolved therein, is recovered from the bottom of the column D1. This stream is expanded by means of the valve V3 and collected In the separator S3. The gases released as a result of the expansion are discharged by means of line (7) and used as energy source for the running of the process. The remaining liquid phase (8), after further expansion in V4 and heating in E2 is fed to the stripping column D2 operating with a reboiler at the bottom E3.

A gas stream (9) essentially consisting of methane and virgin naphtha entrained by the methane itself during the stripping, is recovered from the head of the column D2. The gas stream (9) is expanded in V5, cooled first in the recovery exchanger E4 and then in the exchanger E5, connected to the cooling cycle PK1, and is then sent to the separator S2.

The liquid collected on the bottom of the separator S2 is recycled (10) to the head of the column D2, as reflux, by means of the pump P1. The gas (11) consisting of methane and possibly non-absorbed nitrogen in a concentration of less than 10% molar, after the discharging of frigories in E4, is sent into a distribution network.

The virgin naphtha (12) is recovered from the bottom of the column D2 and, after first cooling in the air exchanger E6 and then in the exchanger E2, followed by the exchanger E7 connected to the cooling cycle PK2, is pumped, in P2, to the head of the absorption column D1. As the gas in the feeding may contain significant traces of upper $C_5$+hydrocarbons which accumulate in the virgin naphtha, a flushing (3) is carried out to keep the flow-rate of virgin naphtha constant in the cycle.

For illustrative but non-limiting purposes, an experimental test is provided hereunder, operating according to the scheme of the enclosed figure.

Natural gas is adopted, available at 60 bar, having the following composition:

| | mol % |
|---|---|
| $C_1$ | 63.98 |
| $C_2$ | 2.22 |
| $C_3$ | 1.32 |
| $C_4$ (i + n) | 1.10 |
| $C_5$ (i + n) | 0.87 |
| $nC_6$ | 0.88 |
| $C_{7+}$ | 0.48 |
| $CO_2$ | 17.42 |
| $N_2$ | 11.73 |

The gas is pretreated by permeation on membranes to eliminate the $CO_2$. A gas stream (1) having the following composition, is obtained:

| | mol % |
|---|---|
| $C_1$ | 78.64 |
| $N_2$ | 14.42 |
| others | 6.94 |

60,000 $Sm^3/g$ of this gas stream are fed to the base of the absorption packed column D1 operating at 60 bar, a temperature at the head of 25° C., a temperature at the bottom of 29° C. The recycled virgin naphtha (12) is fed (2) to the head of the same column, at a temperature of 25° C. and a pressure of about 62 bar, containing about 4% in moles of methane. As virgin naphtha, a mixture essentially consisting of $C_5$–$C_8$ hydrocarbons with an average boiling point of about 95° C., is used.

A stream (4) is recovered from the head of the absorption column D1 and is expanded, cooled and then discharged from the productive cycle (5). This stream has a flow-rate of about 8,700 $Sm^3/g$ and the following composition:

| | mol % |
|---|---|
| $C_1$ | 34.00 |
| $N_2$ | 63.00 |
| others | 3.00 |

A liquid stream (6) consisting of virgin naphtha containing about 20% in moles of methane and 2% of residual nitrogen (1340 $Sm^3/g$) is discharged from the base of the column D1. This stream is expanded at 55 bar and collected in the separator S3. A gas stream (7), equal to 80 $Sm^3/g$, used as fuel gas, is discharged from the head of the separator, whereas the liquid stream (8) of virgin naphtha containing about 19% in moles of methane and 1.67% in moles of nitrogen, is recovered from the base.

The stream (8) is first preheated to 45° C. and then sent to the stripping column D2, operating at 25 bar, a temperature at the head of 43° C., a temperature at the bottom of 165° C.

A gas stream is recovered from the head of the column D2 and, after expansion and cooling, is separated from the condensed products in S2. The methane (11) is recovered from this tank with a flow-rate of 50,800 $Sm^3/g$. The gas has the following composition:

| | mol % |
|---|---|
| $C_1$ | 86.53 |
| $N_2$ | 6.14 |
| others | 7.33 |

1200 $Sm^3/g$ of virgin naphtha are recovered from the bottom of the column D2, which is cooled to 25° C. in E6, E2, E7 and then pumped to the absorption column, after flushing (3) of 2.62 $m^3/g$.

What is claimed is:

1. A process for the removal of nitrogen contained in natural gas which comprises:

a) absorbing the hydrocarbon component of natural gas by means of virgin naphtha, essentially consisting of $C_5$–$C_8$ paraffins, in an absorption device, discharging the non-absorbed nitrogen;

b) stripping the hydrocarbon component from the virgin naphtha in a stripping column operating at a temperature at the bottom ranging from 150 to 200° C.;

c) recycling the virgin naphtha, recovered in the stripping, to step (a);

d) feeding the stripped hydrocarbon component to a distribution network.

2. The process according to claim 1, wherein the natural gas is pretreated to eliminate carbon dioxide.

3. The process according to claim 2, wherein the removal of carbon dioxide from the natural gas takes place by means of permeation through membranes.

4. The process according to claim 1, wherein the absorption step takes place in a packed column.

5. The process according to claim 1, wherein the absorption step is carried out at room temperature.

* * * * *